US011245975B2

(12) United States Patent
Boluriaan et al.

(10) Patent No.: US 11,245,975 B2
(45) Date of Patent: Feb. 8, 2022

(54) TECHNIQUES FOR WIND NOISE REDUCTION

(71) Applicant: BOSE CORPORATION, Framingham, MA (US)

(72) Inventors: Said Boluriaan, Acton, MA (US); Joseph A. Coffey, Jr., Hudson, MA (US); Eric Carl Mitchell, Seekonk, MA (US); Zachary David Provost, Marlborough, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 16/426,888

(22) Filed: May 30, 2019

(65) Prior Publication Data

US 2020/0382858 A1 Dec. 3, 2020

(51) Int. Cl.

| | |
|---|---|
| ***H04R 3/00*** | (2006.01) |
| ***H04R 5/033*** | (2006.01) |
| ***H04R 1/10*** | (2006.01) |
| ***H04R 29/00*** | (2006.01) |

(52) U.S. Cl.

CPC ..... *H04R 1/1083* (2013.01); *H04R 1/1008* (2013.01); *H04R 1/1066* (2013.01); *H04R 3/005* (2013.01); *H04R 5/0335* (2013.01); *H04R 29/006* (2013.01)

(58) Field of Classification Search

CPC .... H04R 1/1083; H04R 3/005; H04R 1/1066; H04R 29/006; H04R 1/1008; H04R 5/0335

See application file for complete search history.

(56) References Cited

U.S. PATENT DOCUMENTS

| | | | | |
|---|---|---|---|---|
| 7,537,964 | B2 * | 5/2009 | Minervini | B81B 7/0064 29/594 |
| 9,156,684 | B1 * | 10/2015 | Minervini | H01L 21/78 |
| 9,363,589 | B2 * | 6/2016 | Lippert | H04R 1/023 |
| 9,544,678 | B2 * | 1/2017 | Lorenz | H04R 1/2853 |
| 10,167,188 | B2 * | 1/2019 | Agashe | B81B 7/0038 |

(Continued)

FOREIGN PATENT DOCUMENTS

CN 109218881 A 1/2019

OTHER PUBLICATIONS

U.S. Appl. No. 16/102,163 entitled "Two Layer Microphone Protection" filed Aug. 13, 2018.

(Continued)

*Primary Examiner* — Oyesola C Ojo

(74) *Attorney, Agent, or Firm* — Patterson + Sheridan, LLP

(57) ABSTRACT

Certain aspects of the present disclosure provide an apparatus. The apparatus comprises a support structure comprising at least one microphone sensor, and a first material layer disposed adjacent to the support structure, wherein a first layer of air is formed between the first material layer and the support structure, the first layer of air being adjacent to the microphone sensor. In certain aspects, multiple material layers may be used, each of the material layers forming a layer of air. For instance, the apparatus may also include a second material layer disposed adjacent to the first material layer, wherein a second layer of air is formed between the first material layer and the second material layer.

20 Claims, 5 Drawing Sheets

(56) References Cited

U.S. PATENT DOCUMENTS

2008/0118096 A1* 5/2008 De Pooter ..... H04R 1/086 381/359
2011/0013799 A1* 1/2011 Fang ..... H04R 1/086 381/355
2011/0255728 A1 10/2011 Abe et al.
2012/0027241 A1* 2/2012 Turnbull ..... H04R 1/086 381/365
2012/0087530 A1* 4/2012 Hawker ..... H04R 1/083 381/361
2012/0177229 A1* 7/2012 Lorenz ..... H04R 1/2853 381/111
2013/0035744 A1 2/2013 Wiskerke et al.
2014/0064542 A1* 3/2014 Bright ..... H04R 1/086 381/359
2014/0072164 A1* 3/2014 Cohen ..... H04R 1/086 381/359
2015/0141774 A1* 5/2015 Ogawa ..... A61B 5/349 600/301
2015/0304753 A1* 10/2015 Loeppert ..... H04R 1/086 381/111
2016/0037243 A1* 2/2016 Lippert ..... H04R 1/086 381/166
2016/0228826 A1 8/2016 Furuuchi
2016/0378142 A1 12/2016 Cardinali et al.
2017/0048625 A1* 2/2017 Salmon ..... H04R 1/021
2017/0245036 A1* 8/2017 Kuki ..... H04R 1/086
2018/0041828 A1 2/2018 Sibbald et al.
2020/0092659 A1* 3/2020 Perletti ..... H04R 1/2807
2020/0169818 A1* 5/2020 Rombach ..... B81B 7/0061

OTHER PUBLICATIONS

International Search Report and Written Opinion for International Application No. PCT/US2020/034870 dated Oct. 6, 2020.

* cited by examiner

TECHNIQUES FOR WIND NOISE REDUCTION

BACKGROUND

Aspects of the present disclosure generally relate to a microphone device.

Headphones and speakers can include any number of microphones. The microphones may be used for, but would not be limited to, one or more simultaneous or asynchronous conditions of the following uses: active noise cancellation, noise reduction, and/or communication. Microphones may be used in various environments that may impact user experience. For example, in a harsh environment, microphones should be protected against water, sweat, dust, etc. As another example, in windy conditions, wind noise may degrade the quality of the audio signal sensed by the microphone. Therefore, there is a need for improvements in the signal-to-wind noise ratio of microphones.

SUMMARY

All examples and features mentioned herein can be combined in any technically possible manner.

Certain aspects of the present disclosure provide an apparatus. The apparatus comprises a support structure comprising at least one microphone sensor, and a first material layer disposed adjacent to the support structure, wherein a first layer of air is formed between the first material layer and the support structure, the first layer of air being adjacent to the microphone sensor.

In certain aspects, the support structure comprises an enclosure having a cavity, the at least one microphone sensor being in the cavity, and wherein the first material layer is adjacent to an opening of the cavity. In certain aspects, the first material layer comprises a screen of acoustically resistive material.

In certain aspects, the first material layer comprises a membrane. In certain aspects, the membrane is at least one of water proof or dust proof.

In certain aspects, the apparatus further comprises a second material layer disposed adjacent to the first material layer, wherein a second layer of air is formed between the first material layer and the second material layer. In certain aspects, the apparatus further comprises a third material layer disposed adjacent to the second material layer, wherein a third layer of air is formed between the second material layer and the third material layer. In certain aspects, each of the first material layer, the second material layer, and the third material layer comprises a membrane or layer of acoustically resistive material.

In certain aspects, the at least one microphone sensor comprises a high-impedance microphone sensor. In certain aspects, the high-impedance microphone sensor comprises a Micro Electro-Mechanical System (MEMS) microphone sensor.

Certain aspects of the present disclosure provide a method for sensing an audio signal. The method generally includes sensing the audio signal via at least one microphone sensor supported by a support structure, the audio signal being received through a first material layer disposed adjacent to the microphone sensor, wherein a first layer of air is formed between the first material layer and the support structure, the first layer of air being adjacent to the support structure, and generating an electric signal based on the audio signal via the microphone sensor.

In certain aspects, the support structure comprises an enclosure having a cavity, the at least one microphone sensor being in the cavity, and wherein the first material layer is adjacent to an opening of the cavity. In certain aspects, the first material layer comprises a screen of acoustically resistive material.

In certain aspects, the first material layer comprises a membrane. In certain aspects, the membrane is at least one of water proof or dust proof.

In certain aspects, the audio signal is received through a second material layer disposed adjacent to the first material layer, wherein a second layer of air is formed between the first material layer and the second material layer. In certain aspects, the audio signal is received through a third material layer disposed adjacent to the second material layer, wherein a third layer of air is formed between the second material layer and the third material layer. In certain aspects, each of the first material layer, the second material layer, and the third material layer comprises a membrane or layer of acoustically resistive material.

In certain aspects, the at least one microphone sensor comprises a high-impedance microphone sensor. In certain aspects, the high-impedance microphone sensor comprises a MEMS microphone sensor.

DETAILED DESCRIPTION

Certain aspects of the present disclosure provide techniques for reducing flow noise on microphones or other pressure transducers that may be caused due to wind or other airborne local pressure fluctuations. The techniques described herein are effective for any high-impedance microphone or pressure transducer, as described in more detail below. For example, the techniques described herein may be effective for any microphone in which the total impedance of the microphone (e.g., diaphragm, port, and front cavity) is significantly higher than that of the total impedance of the wind noise treatment system described herein. One example of a high-impedance microphone is a Micro-Electro-Mechanical Systems (MEMS) microphone.

While certain examples provided herein describe techniques for reducing flow noise for a MEMS microphone to facilitate understanding, the aspects described herein may be implemented for any suitable microphone. Aspects of the present disclosure may be applied to reduce flow noise for a wide variety of microphone systems, such as wearable microphone devices in various form factors. These form factors include, but are not limited to audio eyeglasses, hearing assistance devices, and other head, shoulder, or body worn audio devices that include one or more acoustic drivers to produce sound, with or without contacting the ears of a user.

Figure 1:
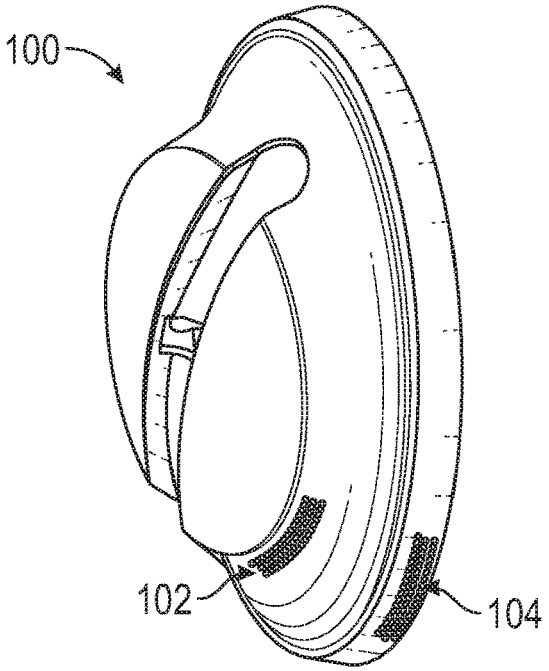
FIG. 1 illustrates an example headphone cover for one headphone of a headset.

FIG. 1 illustrates an example headphone cover 100 for one headphone of a headset. The headphone cover 100 includes a set of perforations 102, 104 at two locations. Each of the sets of perforations 102 and 104 on the headphone cover 100 is associated with a separate microphone element opening visible to the outside world. While two sets of perforations are illustrated, a headphone cover may include more than two or fewer than two sets of perforations. While not shown in FIG. 1, there may be one or more apertures behind the perforations leading to the microphone elements.

Figure 2:
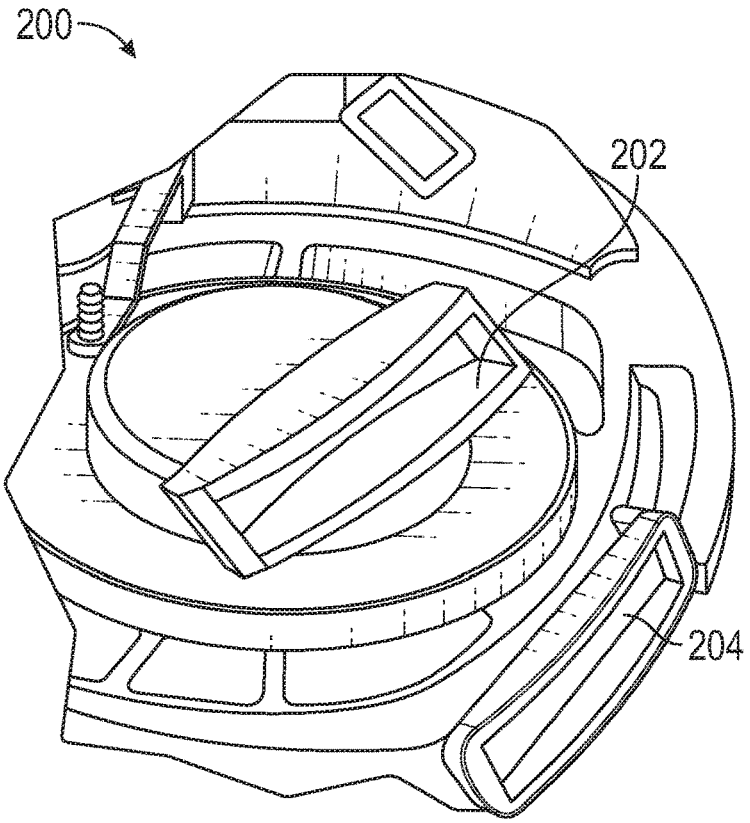
FIG. 2 illustrates an interior portion of a headphone after removal of a headphone cover.

FIG. 2 illustrates an interior portion of a headphone 200 after removal of a headphone cover such as the headphone cover 100 illustrated in FIG. 1. Two enclosures 202 and 204 are illustrated. Each enclosure defines a respective (first) cavity. The cavity of the enclosures is coupled to a respective microphone element (not illustrated). The microphone elements include a microphone sensor disposed in a microphone cavity. In accordance with certain aspects of the present disclosure, one or more material layers may be implemented to reduce flow noise and protect the microphone sensor from water and dust ingress, as described in more detail herein. In some cases, the one or more material layers may be disposed at an outer end of the each enclosure 202 and 204.

Microphone sensors may be housed inside a microphone element (which may be referred to as a microphone assembly). The microphone element that houses the microphone sensor can have a sound opening through the top cover of the microphone element, referred to as a top-port microphone element, or through the bottom substrate of the microphone element, referred to as a bottom-port microphone element. In an aspect, the bottom surface of the microphone element is a substrate, a printed circuit board (PBC), or a flexible circuit board. It should be noted that the aspects described herein are not limited to a top-port microphone element and may be implemented for both top-ported and bottom-ported MEMS microphone elements.

Figure 3:
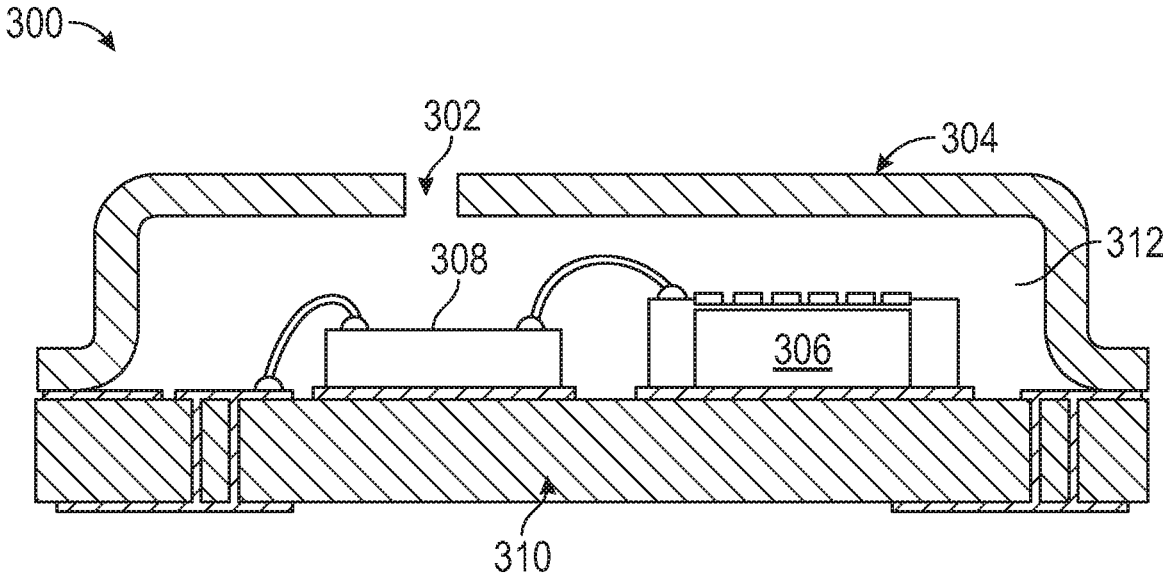
FIG. 3 illustrates an example of a top-port microphone element.

FIG. 3 illustrates an example of a top-port microphone element 300. A sound opening 302 extends through a cover plate 304 or top cover of the microphone element. The microphone sensor 306 is located within the microphone element 300. In the case that the microphone sensor 306 is a MEMS device, the microphone sensor 306 is coupled to an application-specific integrated circuit (ASIC) 308. The microphone sensor 306 and the ASIC 308 are disposed on a substrate 310 such as a PCB substrate or a flexible circuit board. In an aspect, the flexible circuit board is free of wires (leads). The microphone sensor 306 is located in a microphone cavity 312 defined by the cover plate 304 and the substrate 310.

Certain aspects of the present disclosure provide techniques for reducing flow noise for a microphone with little to no impact on the quality of an audio signal sensed by the microphone. In windy environments, it is important to reduce wind noise without reducing audio signal quality to improve user experience. Certain aspects of the present disclosure may be applied to microphones implemented with a relatively small cavity by forming a material layer (e.g., membrane or any acoustically resistive layer) above the cavity with a thin layer of air between the material layer and a support structure (e.g., enclosure) of a cavity having the microphone sensor. The layer of air may be as thin as 100 microns, or less in some examples, although the layer of air may be implemented with thickness greater than 100 microns in other examples.

Figure 4:
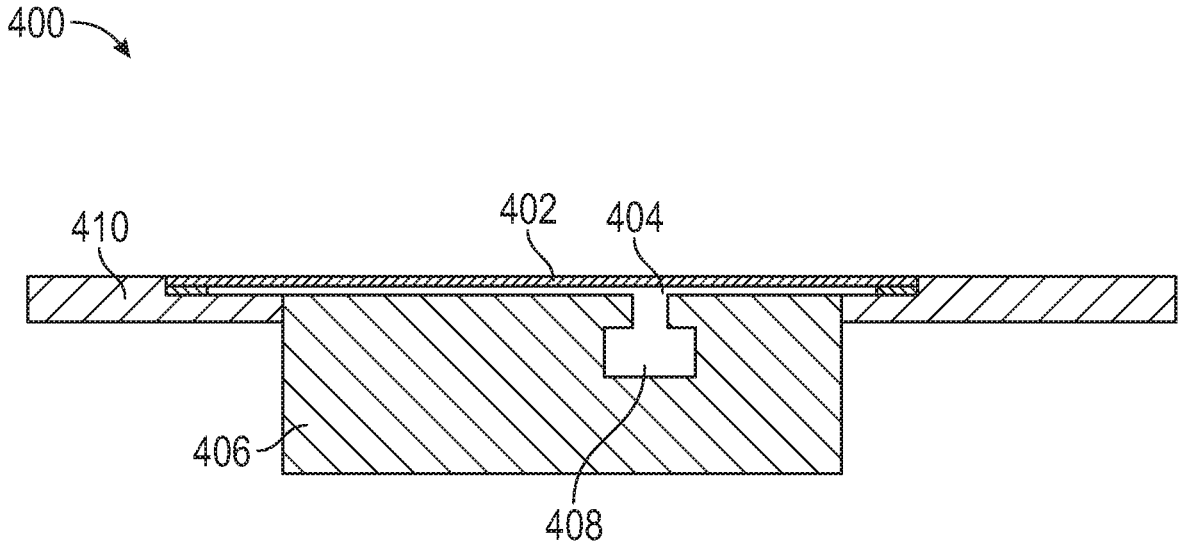
FIG. 4 illustrates an example Micro Electro-Mechanical System (MEMS) microphone, in accordance with certain aspects of the present disclosure.

FIG. 4 illustrates an example MEMS microphone 400, in accordance with certain aspects of the present disclosure. As illustrated, the MEMS microphone 400 may include a support structure (e.g., enclosure 406) having a cavity 408 and a microphone sensor (e.g., as described with respect to FIG. 3) disposed in the cavity 408. A material layer 402 having acoustic resistivity, such as a resistive mesh or micro-perforated plate, may be disposed adjacent to the cavity 408. In an example, the material layer 402 may be supported adjacent to the microphone sensor inside the cavity 408 via a support structure 410. As illustrated, the material layer 402 may form an air layer 404 between the material layer 402 and the face of the microphone or enclosure 406.

The material layer 402 and the air layer 404 allow for reduction of wind noise as sensed by the MEMS microphone 400. For example, partially correlated pressure fluctuations on the material layer, which may be caused due to the wind, add up in the air layer 404, resulting in wind noise reduction as sensed by a microphone sensor in the cavity 408. That is, wind that comes into contact with the MEMS microphone 400 generates pressure fluctuations on the material layer 402 which are only partially correlated (e.g., have different phases). The pressure fluctuations propagate in the air layer 404 and add up, effectively cancelling each other since the pressure fluctuations have different phases. On the other hand, acoustic wavelengths have a longer wavelength as compared to the dimensions of the air layer. Moreover, the acoustic wavelengths are correlated over the surface of the material layer 402, and therefore, are not attenuated by the material layer 402 and the air layer 404. Accordingly, the air layer 404 acts as an adder of the pressure fluctuations caused by wind, and since the pressure fluctuations are partially correlated, the pressure fluctuations cancel each other out in the air layer 404, with little to no impact on audio signals.

Figure 5:
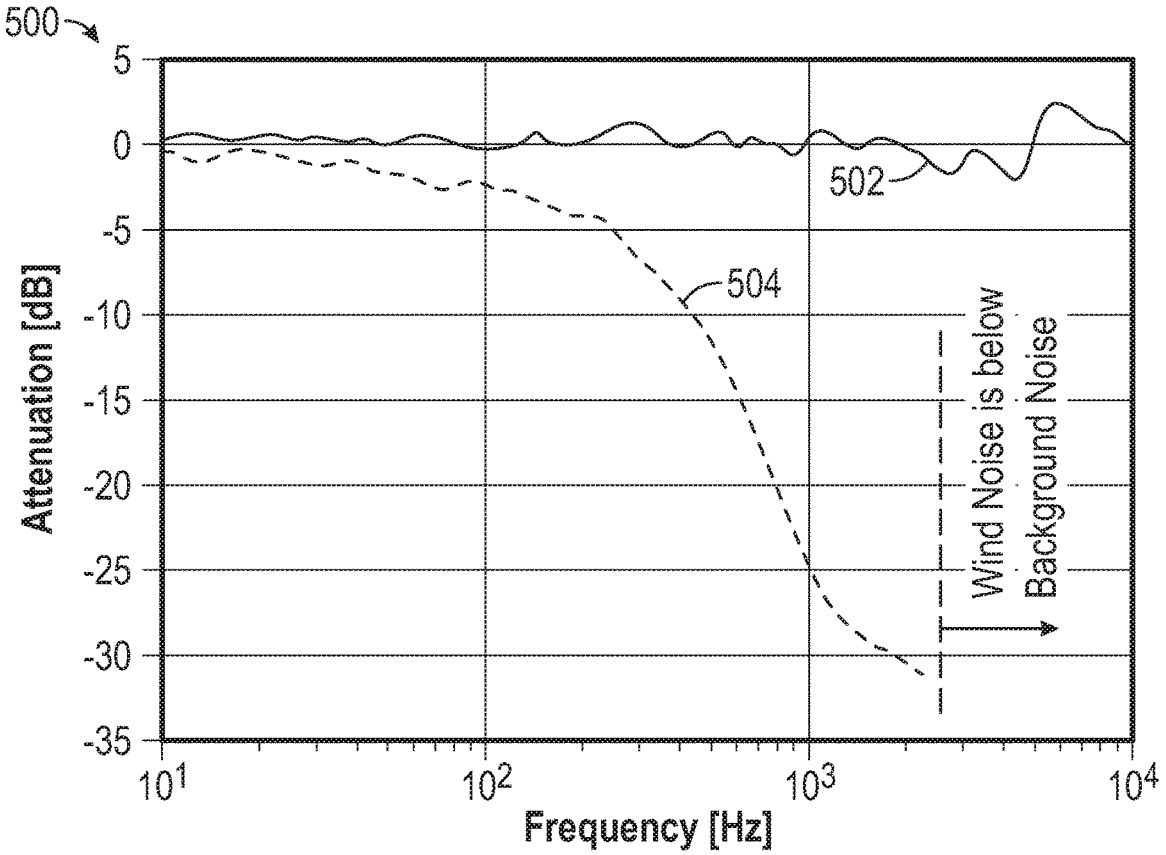
FIG. 5 is a graph illustrating attenuation of an audio signal and wind noise, in accordance with certain aspects of the present disclosure.

FIG. 5 is a graph 500 illustrating attenuation of an audio signal 502 and wind noise 504, in accordance with certain aspects of the present disclosure. As illustrated, the wind noise 504 is reduced (e.g., by as much as −30 dB) in a frequency band of interest by the combination of the material layer 402 and the air layer 404 with little to no impact on the audio signal 502. The wind noise reduction, and consequently the signal-to-wind noise ratio, may be further improved by using a multi-layer system. For example, multiple material layers having acoustic resistivity may be formed, each of the material layers forming a layer of air between each layer.

Figure 6:
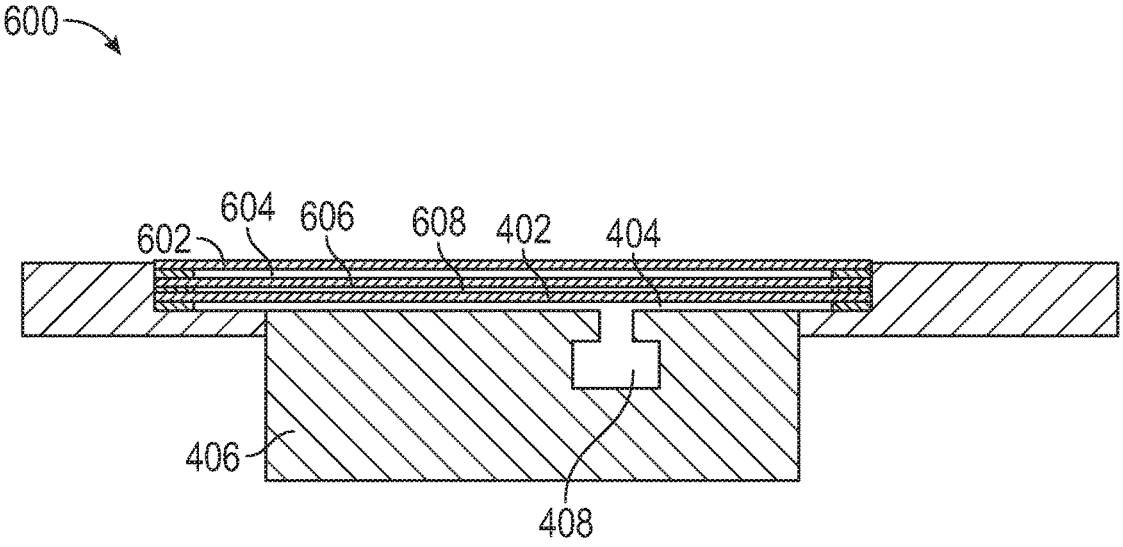
FIG. 6 illustrates an example MEMS microphone implemented with multiple material layers having acoustic resistivity, in accordance with certain aspects of the present disclosure.

FIG. 6 illustrates an example MEMS microphone 600 implemented with multiple material layers having acoustic resistivity, in accordance with certain aspects of the present disclosure. As illustrated, the MEMS microphone 600 includes a material layer 602, a material layer 606, and a material layer 402, each of the material layers having acoustic resistivity and forming an air gap. For example, a layer of air 604 is formed between the material layer 602 and the material layer 606, a layer of air 608 is formed between the material layer 606 and the material layer 402, and an air layer 404 is formed between the material layer 402 and the enclosure 406.

Figure 7A:
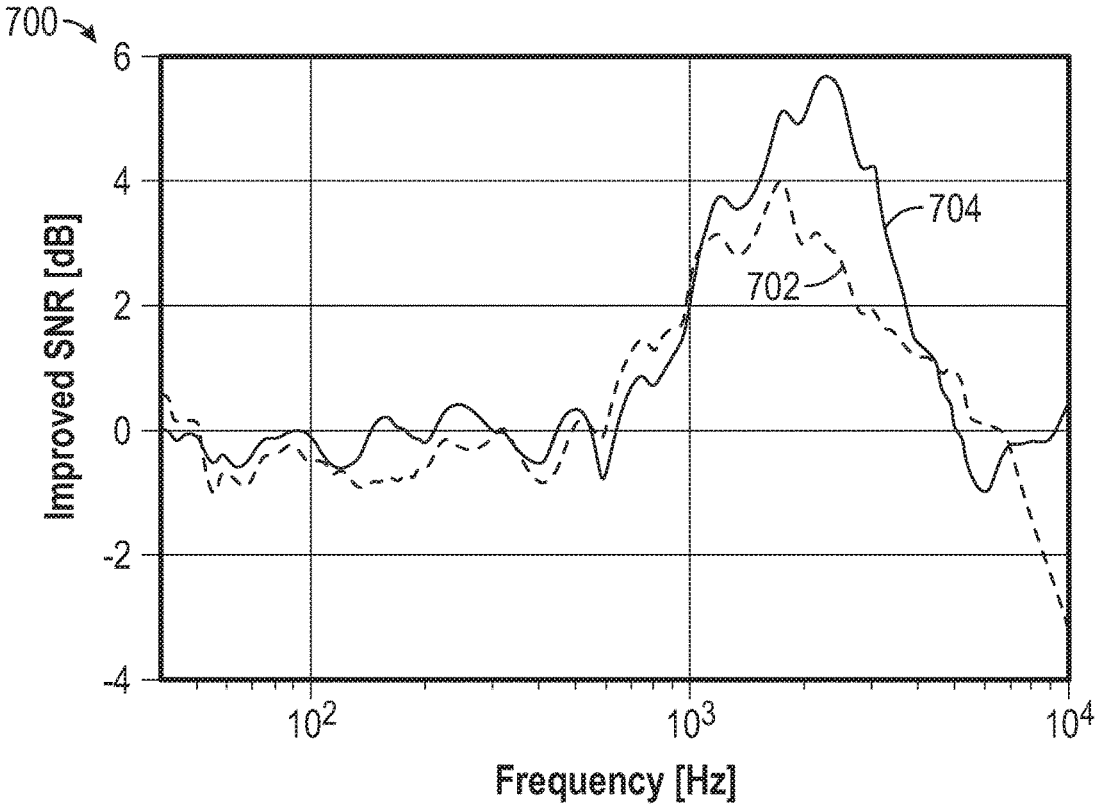
FIGS. 7A and 7B are graphs illustrating improvements in signal-to-wind noise ratio (SNR) of MEMS microphones implemented using multiple material layers, in accordance with certain aspects of the present disclosure.
Figure 7B:
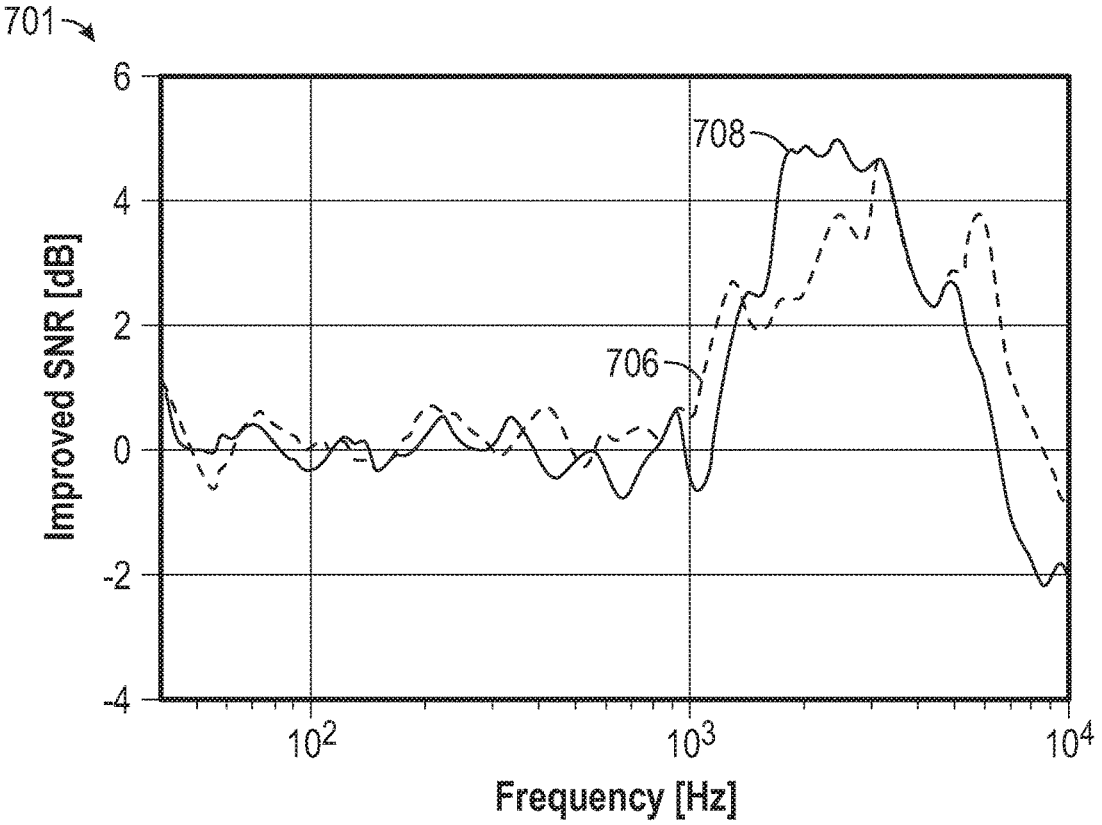

FIGS. 7A and 7B are graphs 700, 701 illustrating improvements in signal-to-wind noise ratio (SNR) of MEMS microphones implemented using multiple material layers as compared to a single material layer implementation, in accordance with certain aspects of the present disclosure. The graph 700 includes a curve 702 illustrating the signal-to-wind noise ratio improvement of a MEMS microphone implemented with two material layers having an acoustic impedance of 700 Rayls, as compared to a single material layer implementation (e.g., as described with respect to FIG. 4). The graph 700 also includes a curve 704 illustrating the signal-to-wind noise ratio improvement of a MEMS microphone implemented with three material layers having acoustic impedance of 700 Rayls, as compared to a single material layer implementation.

The graph 701 includes a curve 706 illustrating the signal-to-wind noise ratio improvement of a MEMS microphone implemented with two material layers having an acoustic impedance of 3300 Rayls, as compared to a single material layer implementation. The graph 701 also includes a curve 708 illustrating the signal-to-wind noise ratio improvement of a MEMS microphone implemented with three material layers having acoustic impedance of 3300 Rayls, as compared to a single material layer implementation.

As illustrated by graphs 700, 701, an improvement of up to 5 dB may be realized as compared to a single material layer implementation. Moreover, the improvement in signal-to-wind noise ratio is realized within a favorable vocal frequency band (e.g., between about 800 Hz and 5 kHz).

Figure 8:
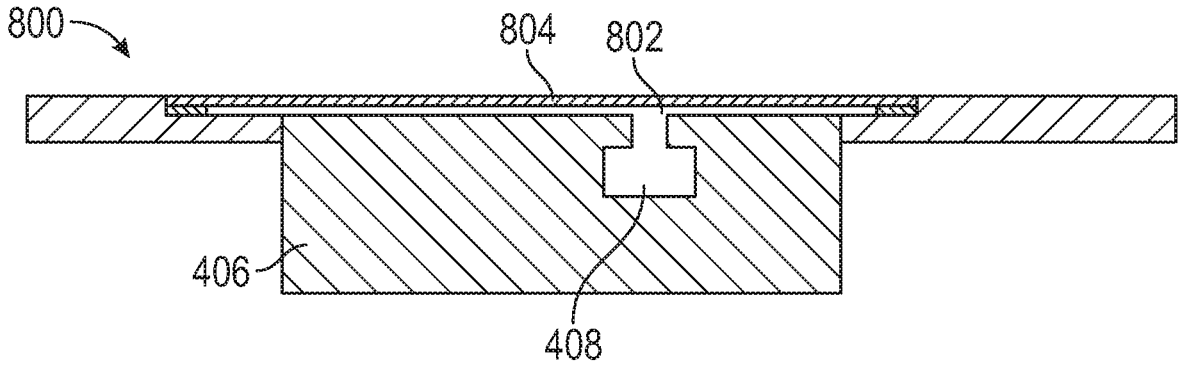
FIG. 8 illustrates an example MEMS microphone having a material layer implemented using a membrane, in accordance with certain aspects of the present disclosure.

FIG. 8 illustrates an example MEMS microphone 800 having a material layer implemented using a membrane 804 having acoustic impedance, in accordance with certain aspects of the present disclosure. As illustrated, the membrane 804 forms a layer of air 802 between the membrane 804 and the enclosure 406. The membrane 804 may be a water and/or dust proof screen. Thus, adding the membrane 804 improves the signal-to-wind noise ratio of the MEMS microphone 800 while making the MEMS microphone 800 dust and water proof. In certain aspects, the membrane 804 may be used in addition to one or more material layers having acoustic resistivity to provide further improvements to the signal-to-wind noise ratio of the MEMS microphone.

Figure 9:
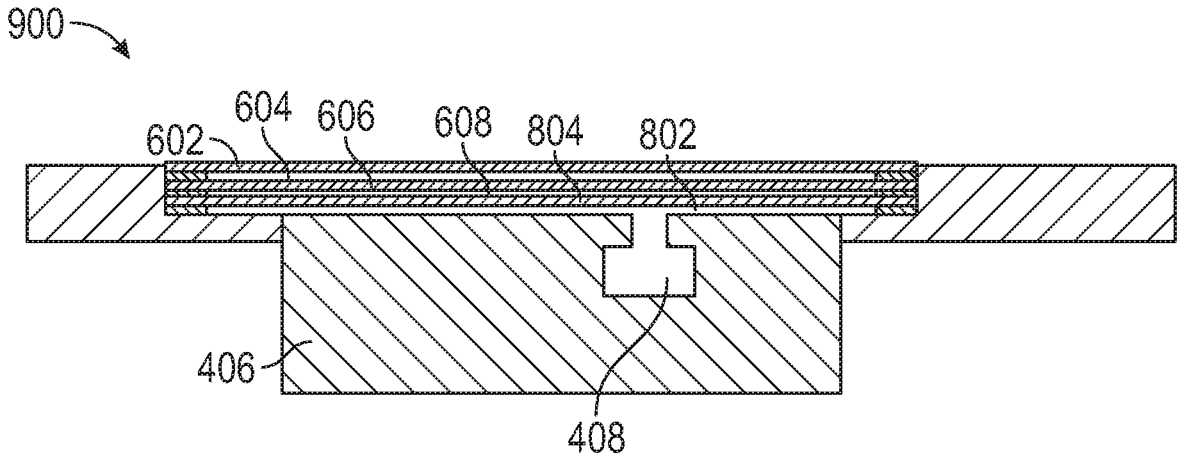
FIG. 9 illustrates an example MEMS microphone having a membrane and material layers, in accordance with certain aspects of the present disclosure.

FIG. 9 illustrates an example MEMS microphone 900 having a membrane 804 and material layers 602, 606, in accordance with certain aspects of the present disclosure. The MEMS microphone 900 may be water and/or dust proof due to the membrane 804 being implemented over the cavity 408, while also providing additional improvements in the signal-to-wind noise ratio of the MEMS microphone 900, as compared to the MEMS microphone 800, by implementing the material layers 602, 606 above the membrane 804. While the membrane 804 is implemented closer to the enclosure 406 than the material layers 602, 606 in the example MEMS microphone 900, the membrane 804 and material layers 602, 606 may be disposed adjacent to the enclosure 406 in any suitable order.

The techniques described herein have little to no impact on the voice and audio pickup by the microphone since the total system impedance of the air layer (e.g., air layer 404) and the microphone is significantly higher than that of the impedance of the material layer (e.g., material layer 402), resulting in a substantial increase in the signal-to-wind noise ratio as sensed by the microphone. In other words, the level of attenuation of the audio signal is dependent on the ratio of the impedance of the material layer 402 to the total system impedance. With a high-impedance microphone, the total system impedance is much higher than the impedance of the material layer 402, resulting in a relatively insignificant (e.g., minimal) attenuation of the audio signal by the material layer 402. Moreover, due to the high impedance of the microphone, the microphone has little to no impact on the pressure in the layers of air or the physical behavior of material layers or membrane described herein, allowing a relatively small cavity to be implemented for the microphone. Therefore, the sensor or pressure transducer implemented inside the cavity may be implemented as a high impedance device, reducing the attenuation of the audio signal while using a relatively small cavity.

The material layer described herein may be implemented using any material having acoustic resistivity or implemented as a membrane having acoustic impedance. For example, the material layer may be a screen, fabric (e.g., cloth), metal mesh, plate with micro-perforation, plastic film, or any layer of material that acts as an acoustic impedance. In certain aspects, the material layer may be implemented as metal foam if the metal foam provides reasonable acoustic resistivity. The material layer may have various values of acoustic impedance depending on the application.

Figure 10:
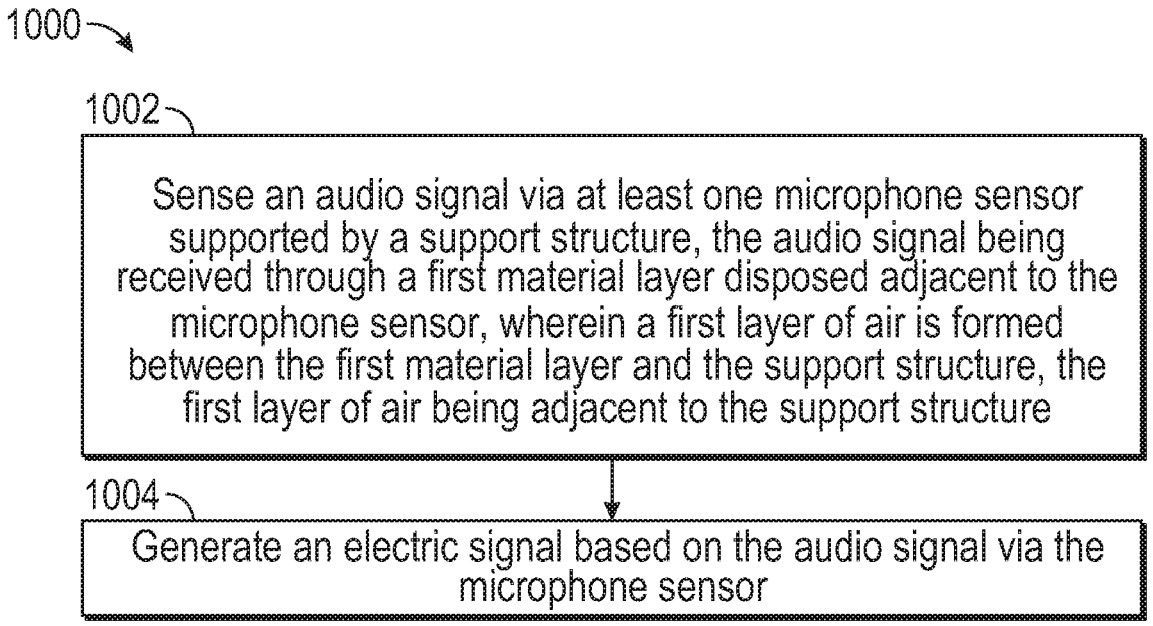
FIG. 10 is a flow diagram illustrating example operations for sensing an audio signal, in accordance with certain aspects of the present disclosure.

FIG. 10 is a flow diagram illustrating example operations 1000 for sensing an audio signal, in accordance with certain aspects of the present disclosure. The operations 1000 may be performed by a microphone, such as the microphone described with respect to FIGS. 4, 6, 8, and 10.

The operations 1000 begin, at block 1002, by the microphone sensing the audio signal via at least one microphone sensor (e.g., a high-impedance microphone sensor such as a MEMS microphone sensor) supported by a support structure (e.g., enclosure 406), the audio signal being received through a first material layer (e.g., material layer 402) disposed adjacent to the microphone sensor. In certain aspects, the first material layer may be a screen of acoustically resistive material. In some cases, the first material layer is a membrane (e.g., membrane 804). The membrane may be water proof and/or dust proof.

In certain aspects, a first layer of air (e.g., air layer 404) is formed between the first material layer and the support structure, the first layer of air being adjacent to the support structure. In some cases, the support structure is an enclosure having a cavity (e.g., cavity 408), the at least one microphone sensor being in the cavity, and the first material layer being adjacent to an opening of the cavity.

In certain aspects, the audio signal is received through a second material layer (e.g., material layer 606) disposed adjacent to the first material layer. A second layer of air (e.g., air layer 608) may be formed between the first material layer and the second material layer. In certain aspects, the audio signal is received through a third material layer (e.g., material layer 602) disposed adjacent to the second material layer. A third layer of air (e.g., air layer 604) may be formed between the second material layer and the third material layer. In some cases, each of the first material layer, the second material layer, and the third material layer may be a membrane or layer of acoustically resistive material. In certain aspects, the operations 1000 continue, at block 1004, by the microphone generating an electric signal based on the audio signal via the microphone sensor.

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein, but is to be accorded the widest scope consistent with the principles and novel features disclosed herein.

The invention claimed is:

1. An apparatus comprising:

a support structure comprising at least one microphone sensor;

a first material layer in contact with the support structure, wherein a first layer of air is formed between the first material layer and the support structure, the first layer of air being adjacent to the microphone sensor and substantially extending the length of the first material layer; and a second material layer disposed adjacent to the first material layer, wherein a second layer of air is formed between the first material layer and the second material layer, and wherein the second layer of air substantially extends the length of the second material layer, wherein the first layer of air and the second layer of air each act as an adder of pressure fluctuations caused by wind to allow for reduction of wind noise sensed by the at least one microphone sensor.

2. The apparatus of claim 1, wherein the support structure comprises an enclosure having a cavity, the at least one microphone sensor being in the cavity, and wherein the first material layer is adjacent to an opening of the cavity.

3. The apparatus of claim 1, wherein the first material layer comprises a screen of acoustically resistive material.

4. The apparatus of claim 1, wherein the first material layer comprises a membrane.

5. The apparatus of claim 4, wherein the membrane is at least one of water proof or dust proof.

6. The apparatus of claim 1, further comprising a third material layer disposed adjacent to the second material layer, wherein a third layer of air is formed between the second material layer and the third material layer, and wherein the third layer of air substantially extends the length of the third material layer.

7. The apparatus of claim 6, wherein each of the first material layer, the second material layer, and the third material layer comprises a membrane or layer of acoustically resistive material.

8. The apparatus of claim 1, wherein the at least one microphone sensor comprises a high-impedance microphone sensor.

9. The apparatus of claim 8, wherein the high-impedance microphone sensor comprises a Micro Electro-Mechanical System (MEMS) microphone sensor.

10. A method for sensing an audio signal, comprising:

sensing the audio signal via at least one microphone sensor supported by a support structure, the audio signal being received through:

a first material layer disposed adjacent to the microphone sensor, wherein a first layer of air is formed between the first material layer and the support structure, the first layer of air being in contact with the support structure and substantially extending the length of the first material layer, and a second material layer disposed adjacent to the first material layer, wherein a second layer of air is formed between the first material layer and the second material layer, and wherein the second layer of air substantially extends the length of the second material layer, wherein the first layer of air and the second layer of air each act as adder of pressure fluctuations caused by wind to allow for reduction of wind noise sensed by the at least one microphone sensor; and generating an electric signal based on the audio signal via the microphone sensor.

11. The method of claim 10, wherein the support structure comprises an enclosure having a cavity, the at least one microphone sensor being in the cavity, and wherein the first material layer is adjacent to an opening of the cavity.

12. The method of claim 10, wherein the first material layer comprises a screen of acoustically resistive material.

13. The method of claim 10, wherein the first material layer comprises a membrane.

14. The method of claim 13, wherein the membrane is at least one of water proof or dust proof.

15. The method of claim 10, wherein the audio signal is received through a third material layer disposed adjacent to the second material layer, wherein a third layer of air is formed between the second material layer and the third material layer, and wherein the third layer of air substantially extends the length of the third material layer.

16. The method of claim 15, wherein each of the first material layer, the second material layer, and the third material layer comprises a membrane or layer of acoustically resistive material.

17. The method of claim 10, wherein the at least one microphone sensor comprises a high-impedance microphone sensor.

18. The method of claim 17, wherein the high-impedance microphone sensor comprises a Micro Electro-Mechanical System (MEMS) microphone sensor.

19. The apparatus of claim 6, wherein a length of the first layer of air, a length of the second layer of air, and a length of the third layer of air are equal.

20. The method of claim 15, wherein a length of the first layer of air, a length of the second layer of air, and a length of the third layer of air are equal.

* * * * *